United States Patent [19]

Wallish et al.

[11] Patent Number: 4,784,277

[45] Date of Patent: Nov. 15, 1988

[54] CAROUSEL DISPLAY

[75] Inventors: Patricia I. Wallish, Libertyville, Ill.; Steve Howard, Richardson, Tex.; Barry Silver, Northbrook, Ill.

[73] Assignee: Patricia I. Wolfe, Libertyville, Ill.

[21] Appl. No.: 42,311

[22] Filed: Apr. 24, 1987

Related U.S. Application Data

[63] Continuation-in-part of Ser. No. 875,788, Jun. 18, 1986.

[51] Int. Cl.[4] ..... A47F 7/00

[52] U.S. Cl. ..... 211/167; 211/73

[58] Field of Search ..... 211/167, 73, 163, 133, 211/131, 13, 72, 56, 59.2, 195; 248/174, 459; 229/171, 17 R; 206/44 R, 44 B, 44.11, 45.29; 40/124

[56] References Cited

U.S. PATENT DOCUMENTS

| | | | |
|---|---|---|---|
| 1,021,998 | 4/1912 | Myers | 211/73 X |
| 1,361,334 | 12/1920 | Kaley | 211/163 |
| 1,677,318 | 7/1928 | Alexander | 211/163 X |
| 1,767,980 | 6/1930 | Hintze | 211/167 X |
| 1,811,315 | 6/1931 | Herren | 211/163 X |
| 1,875,563 | 9/1932 | Coobe et al. | 211/163 X |

FOREIGN PATENT DOCUMENTS

| | | | |
|---|---|---|---|
| 1042153 | 9/1966 | United Kingdom | 211/195 |

*Primary Examiner*—J. Franklin Foss
*Assistant Examiner*—Sarah A. Lechok Eley
*Attorney, Agent, or Firm*—Thomas R. Vigil

[57] ABSTRACT

This application discloses a display carousel including a stationary base, a polygonic rotatable support element, a bearing having an annular rim mounted on a support rod and receiving slots for product cards. The polygonic rotatable support element has a plurality of support faces upon which the product cards are received between lateral and axial restraints. The polygonic rotatable support element may be integrally formed from cardboard stock with a top and bottom.

1 Claim, 3 Drawing Sheets

CAROUSEL DISPLAY

This application is a continuation-in-part of my copending design application Ser. No. 875,788 filed June 18, 1986 for: CAROUSEL DISPENSER, Pending.

BACKGROUND OF THE INVENTION

The present invention relates to carousel displays which may be rotated by an individual potentially wishing to purchase a displayed product. More particularly, the invention relates to a rotary display having a number of faces on which a product or a card is displayed.

Displays as such are old and a number of displays have been previously proposed.

U.S. Pat. No. 2,825,519 to Potts et al discloses a DISPLAY STAND. The Potts et al stand is generally of the form of a collapsible truncated pyramid and is fabricated from paperboard. This stand further includes a generally rectangular tray atop the pyramid and a pole extending upward through the tray bottom. The Potts et al stand is generally collapsible into a relatively flat compact condition for shipment or storage, when not deployed to give the effect of a relatively wide display case with a narrower pedestal.

U.S. Pat. No. 3,231,097 to Hodson discloses a DISPOSABLE DISPLAY STAND. The free standing Hodson stand is generally oblong, fabricated from corrugated cardboard, and displays bagged products hung from pegs on each of its four individual panels. The panels include vertical flanges defined by score lines. Staples join a vertical flange to an adjacent panel, near a vertical portion of the adjacent panel remote from the vertical flange of the adjacent panel.

U.S. Pat. No. 3,314,531 to Cheris et al discloses a SHIPPER DISPLAY. The Cheris et al shipper includes a carton having telescoping top and bottom portions. The cartons illustrated are either hexagonal or rectangular and contain segregated portions. Each segregated portion contains a product. Cheris et al suggests that the flat carton stock be assembled into the shipper display by the packager of the product. On arrival to a merchandiser, the merchandiser disposes of the top portion of the carton to display the product.

U.S. Pat. No. 3,756,421 to Wilkins discloses a DISPLAY SYSTEM. This permanent display includes a standard, a base, support means and a plurality of separate panels which may be assembled into a variety of hollow polygonic rotatable bodies. Each separate panel includes a polystyrene frame surrounding a pegboard panel. Any type of fastener suitable for use with a pegboard may be employed to affix the product to be displayed.

U.S. Pat. No. 4,193,351 to Belokin, Jr. discloses a DISPLAY RACK ASSEMBLY. The Belokin rack includes a base, a vertical support member, and a plurality of slotted shelves slotted onto the vertical support member from alternating sides. The shelves are fabricated from a lightweight, rigid and strong material such as expanded polystyrene styrofoam. An upper shelf is vertically supported by the product displayed on the shelf immediately beneath it.

U.S. Pat. No. 4,374,560 to Howlett discloses a COLLAPSIBLE DISPLAY BIN STAND. The Howlett stand includes a polygonal-shaped receptacle member supported by a plurality of contiguous polygonal-shaped tubular members. An outer polygonal member includes six main panels and a glue flap which are foldably joined together on parallel fold lines, with the glue flap being secured to the remote side panel to provide a tubular structure open at the top and bottom. Strengthening members are inserted into and joined to the outer member.

U.S. Pat. No. 4,586,619 to Eckert discloses an EYEGLASS FRAME DISPLAY. The Eckert display includes a plurality of molded plastic modules and a cap member to which upper modules may be bolted. Each module is suitable for mounting a pair of eyeglass frames and includes male and female edge portions. The male and female edge portions of a module may be mated with an adjacent module to form a continuous display. The continuous display may be generally flat, triangular or approach the circular as is desired.

Delika Mfg. Co. of Libertyville, Ill. manufactures a generally planar display for analgesic and other pouched products under the trademark RELIEF CENTER. The pouched products are adhered to one side of a double faced adhesive. The second side of the double faced adhesive is in turn adhered to a generally elongated product card. A channel having a general "U" shape with an elongated leg and a short leg is adhered to one side of the planar display with the short leg outward. The channel is disposed in vertical pairs and a horizontal bottom for receiving a product card. When the product on the card is sold, a new card with product replaces the exhausted product card.

None of these structures previously proposed simultaneously address providing a multifaced display bearing product cards which is conveniently shipped by a distributor, and conveniently assembled and replenished by a merchant.

SUMMARY OF THE INVENTION

According to the invention, there is provided a display carousel comprising:

a stationary base adapted to rest on a flat surface;

a polygonic rotatable support element including a plurality of support faces extending axially upward of said base;

bearing means interposed between said stationary base and said rotatable support element for providing axial support to said rotatable support element while allowing it to rotate; and receiving means on said support faces for supporting cards bearing products to be displayed.

DESCRIPTION OF THE PREFERRED EMBODIMENT

Figure 1:
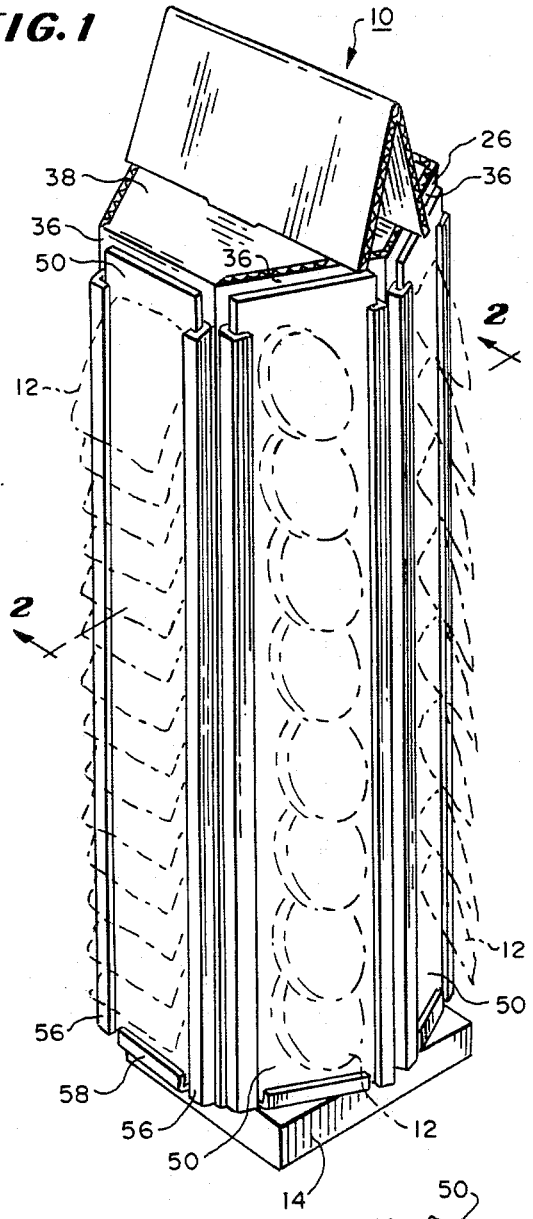
FIG. 1 is a perspective view of the carousel display of the invention.

The carousel display 10 of the present invention is shown in perspective in FIG. 1 with a product 12 generally indicated in phantom. Carousel display or rotary counter display 10, as it is sometimes referred to, includes a stationary base 14 adapted to rest on a flat surface, particularly an upper surface of a store counter.

Stationary base or counter support 14 is shown as a generally rectangular block, economically manufactured 10 from wood. The stationary base or counter support 14 should have sufficient planar area to provide stability for the remaining structure of the carousel display 10.

A support rod 16, inserted into the base 14, extends upwardly from the base 14 to a distal end 18 (FIG. 6) of the rod 16 remote from the base 14. The distal end 18 advantageously bears a hat 20 having a rounded upper surface 22 guarding the distal end 18 of rod 16, which is typically an elongate mild steel cylinder.

The hat 20 is preferably made of a relatively resilient plastic and slides over rod or column 16. A bearing structure 24 is interposed between the base 14 and a polygonic rotatable support element 26 to allow relative rotation between them. The rotatable support element 26 defines a rotary shell 26.

Figure 6:
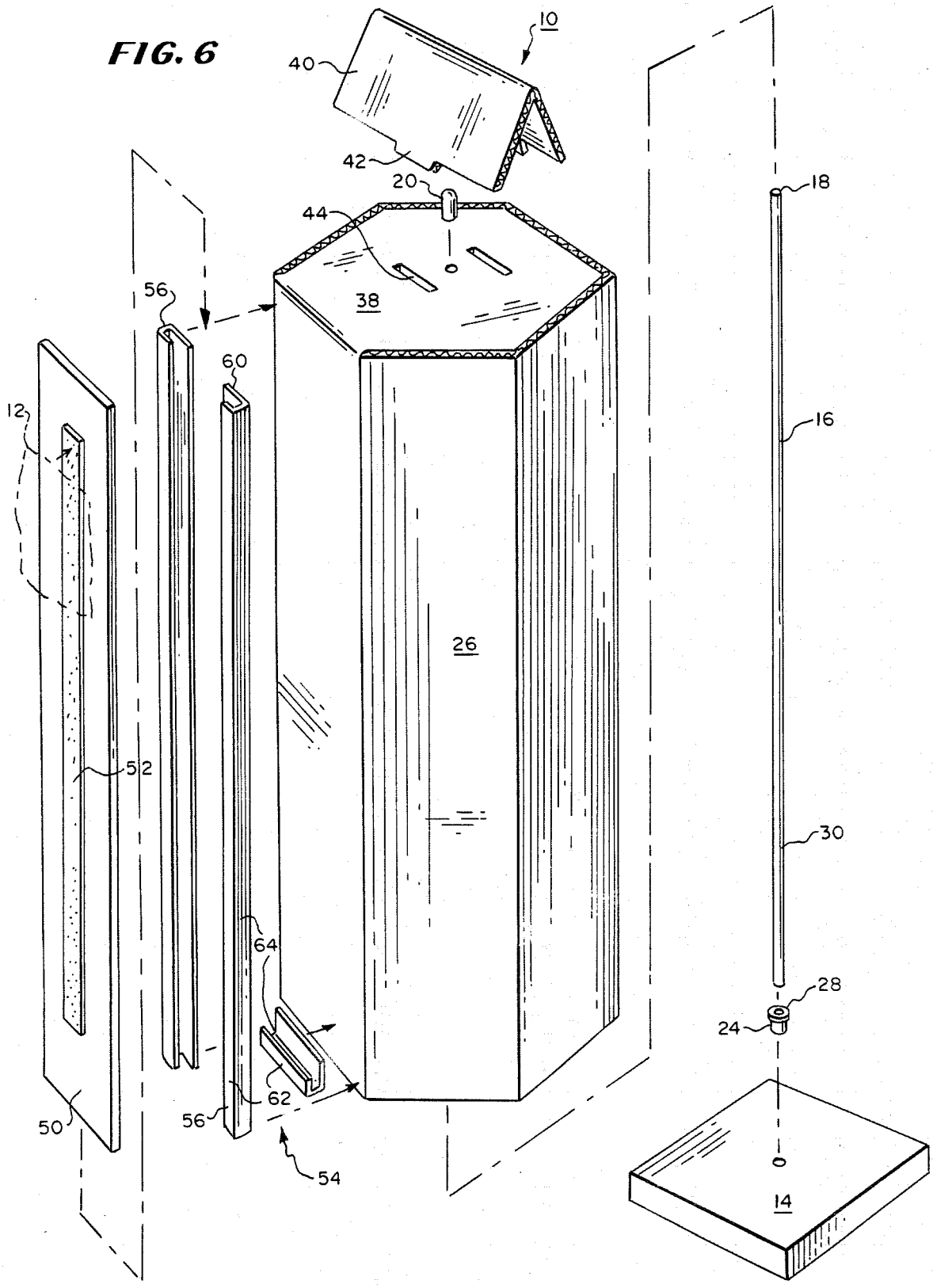
FIG. 6 is an exploded perspective view of the carousel display of the present invention.

In FIG. 6, the bearing structure 24 is shown as an eyelet having an annular flange 28. Preferably, the eyelet or bearing 24 is affixed to rod 16 at the place of manufacture of the carousel display 10, in kit form, to preserve ease of assembly in the field by a merchant. Either the brass of the eyelet 24 or the steel of the rod 16, or both, may be upset by a punch to fix their relative positions, as indicated arbitrarily at 30 in FIG. 6.

The annular flange 28 bears against a bottom surface 32 of a bottom 34 to provide vertical support while allowing the bottom 34 to rotate with respect to the bearing 24. The bottom 34 is affixed to, and closes the lower portion of the hollow hexagonal shell having six support or shell faces 36, which together form the polygonic rotatable support element 26 or rotary shell 26 or simply rotary shell 26.

Figure 2:
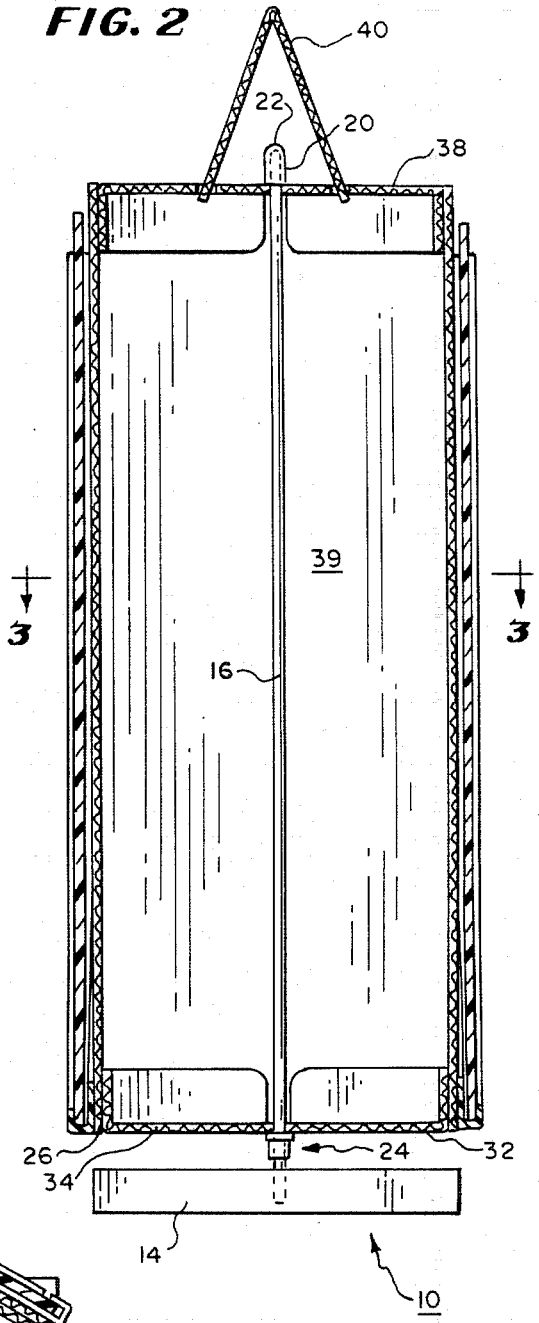
FIG. 2 is a vertical cross-section of the carousel display shown in FIG. 1 and is taken along line 2—2 of FIG. 3 is a horizontal cross-section of a portion of the carousel display shown in FIGS. 1 and 2 and is taken along 3—3 FIG. 2.
Figure 3:
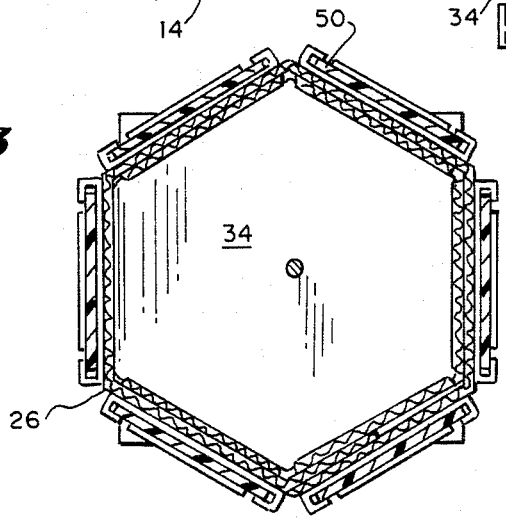

Similarly a top 38 is affixed to, and closes the upper portion of the rotatable support element 26. A stiffener 39, extending between the interior of the faces 36 of rotatable support element 26, or between the top 38 and the bottom 34, or both, is generally shown only in FIG. 2.

A cap 40, which rests on the top 38, is provided to attract a potential customer's attention or identify the nature of product 12. Advantageously, the cap 40 includes at least one cap flange 42 to locate the cap 40 on the top 38. The cap flange 42 is received within a slot 44 in the top 38, and the slot can be dimensioned to establish an interference fit for attaching the top 38 to the cap 40.

As illustrated, a cap 40 having an angle cross-section to provide two faces with two cap flanges 42 is preferred.

Similarly, the arrangement where the rod 16 extends through both a bottom orifice 46 and a top orifice 48 is preferred.

While the product 12 can be attached directly to the faces 36, some inconvenience to the merchant or customer would result. The merchant would have to attach the product 12 to one of the faces 36 to replenish a partially exhausted face or the customer would have to rotate the rotatable support element 26 hopefully to find a face 36 which could not be veiwed still having product thereon.

To mitigate, if not avoid, this dilemma the carousel display 10 employs cards 50 on which product 12 is preferably affixed in shingle fashion, with an upper product 12 partially overlapping the upper portion of a lower product 12. It is convenient to attach product 12 to a card 50 with a double faced adhesive strip 52. The strip 52 is of the type which comes from the manufacturer with a protective covering over the adhesive which is removed before use. A plurality of cards 50 may be employed to display product 12 on a single face 36.

Since the method of replenishing the product 12 really involves replacing the cards 50 bearing the product 12, it is preferable to provide for a convenient manner to change the cards 50. Rather than affixing the cards 50 to the faces 36, a receiving structure, or receiving means, 54 is employed which support a card 50 on a face 36, while allowing an easy change of cards 50. The receiving structure 54 in the manner of the Delika display referred to above, conveniently includes a pair of lateral restraints 56 and a single axial restraint 58 for each face 36 receiving a single card 50. Each restraint 56, 58 is somewhat "U" shaped and has an elongated leg 60 and a short leg 62 joined by a lower portion 64. The restraints 56, 58 are conveniently attached to a card 50 by a double faced adhesive strip of the same type employed to attach products 12 to card 50. The opening of the "U" shape faces the center of card 50 and the short leg 62 extends outwardly.

Figure 4:
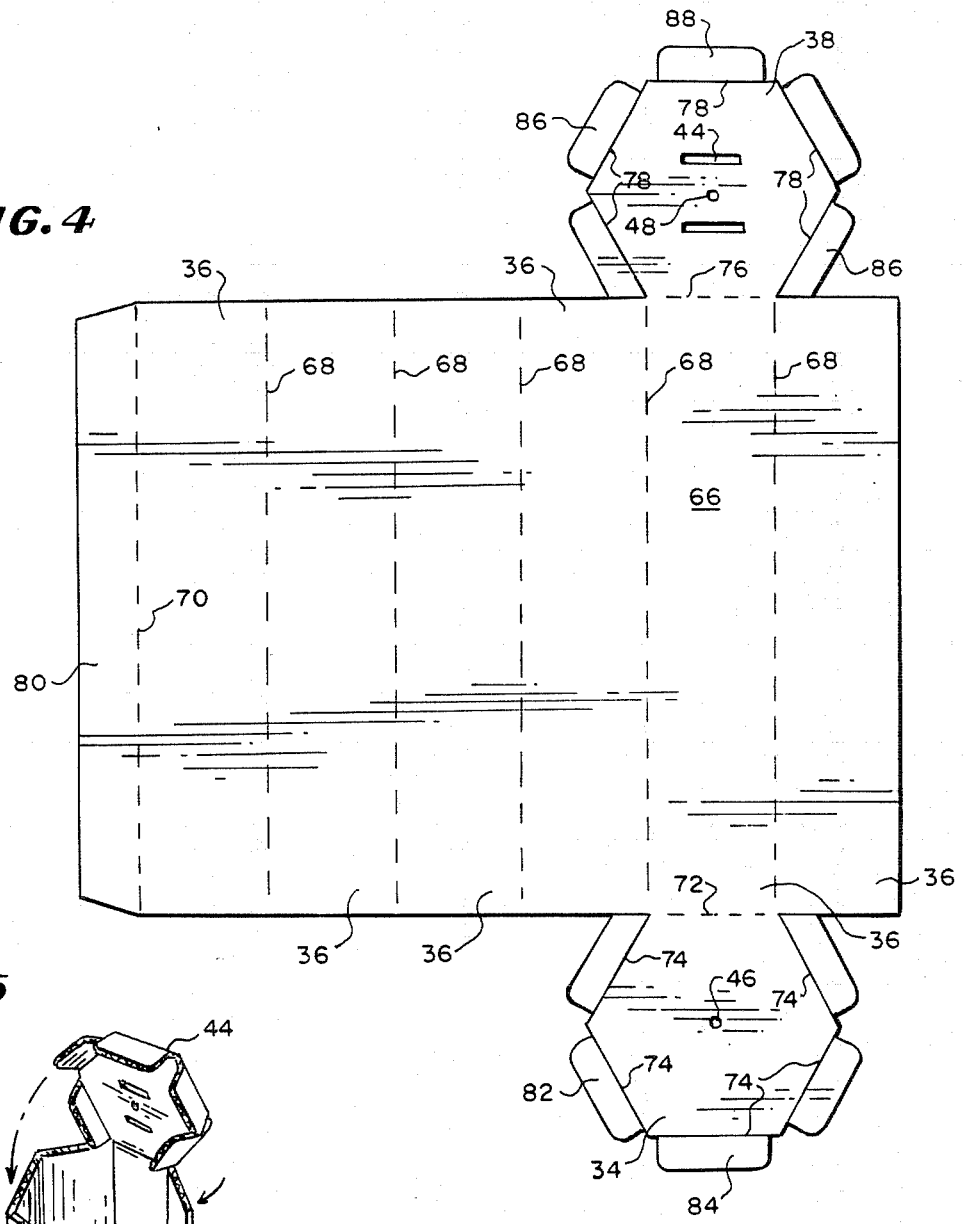
FIG. 4 is a plan view of a paperboard blank from which an integral polygonic rotatable support element and integral top and bottom structure of the carousel display is assembled.

The top 38, the bottom 34, and the rotatable support element 26 are conveniently formed from planar stock, as are cap 40, and cards 50. Planar stock, such as cardboard, is most convenient to ship and is most economical. A reinforced paperboard product such as double faced corrugated paperboard is preferred for major load bearing elements such as the rotatable support element 26 and bottom 34. As illustrated in FIG. 4, several of the components of the carousel display 10 are integrally formed in the paperboard blank or body 66.

The body 66 shown in FIG. 4 includes a planar sheet in which score or fold lines 68 through 78 define areas of the body 66 which are formable into the top 38, the rotatable support element shell 26 and the bottom 34. While score or fold lines 68 through 78 may only be printed on body 66 to indicate a fold line, score lines 68 through 78 more advantageously facilitate a fold. Either a series of perforations or a crimp reducing the thickness of body 66 may define score lines 68 through 78, and either facilitate the folding process.

When double faced corrugated paperboard forms the body 66, crimping is preferred. Score lines 68 define the six faces 36 of the rotatable support element 26. Score line 72 defines the boundary between the rotatable support element 26 and the bottom 34. Score line 76 defines the boundary between the top 38 and the rotatable support element 26.

Score line 70 defines a shell flange 80 which secures adjacent end faces 36. The shell flange 80 is disposed to the interior of the rotatable support element 26 and preferably glued on the interior of a face 36 at the opposite end of the body or blank 66 from the flange 80.

Similarly, the score line 74 define bottom flanges 82, 84 and bend lines 78 define top flanges 86, 88. Although, some of top and bottom flanges 82–88 may be eliminated, they all are preferably present. Each, potentially, is joined to the rotatable support element 26 in a manner similar to the joinder of shell flange 80 to the rotatable support element 26. Preferably distal flanges 84, and 88 are adhered to the interior of the rotatable support element 26 with a double faced adhesive strip of the type employed to adhere the product 12 to the card 50.

The cap 40 may also be integrally formed in the body or blank 66. When so formed, a score line defining it is usefully a series of perforations.

Figure 5:
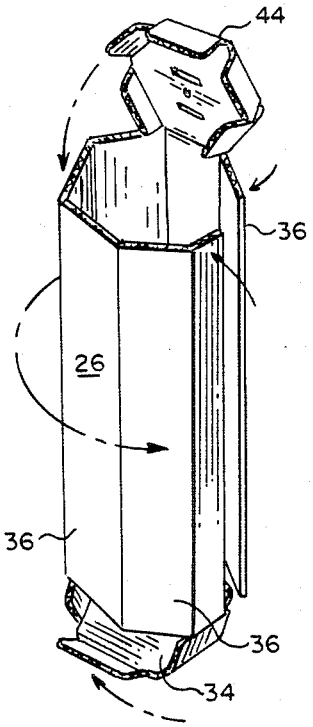
FIG. 5 is a perspective view of the blank shown in FIG. 4 as it is formed into the rotatable support element.

The assembly of the rotatable support element 26 is graphically indicated in FIG. 5. Although polygonic rotatable support element 26 is illustrated as a regular hexagon, it may be irregular and have less or more faces, on which the product 12 is attached in some fashion.

From the foregoing description, it will be apparent that the carousel display of the present invention may be modified without departing from the teaching of the invention. Also apparent is that the carousel display of the present invention has a number of advantages some of which have been described and others of which are inherent. Accordingly, the scope of this invention is only to be limited, as necessitated by the accompanying claims.

I claim:

1. A rotary carousel counter display assembly comprising:

a counter support adapted to rest on a counter;

a column bearing on said base and extending generally upward from said base;

a bearing including an annular flange affixed to said column above said base;

a rotary shell including six integrally connected planar shell panels formed from a blank of generally planar paperboard stock and divided by fold lines; a bottom integrally formed with the blank which is formed into said rotary shell and partially closing a lower portion of said rotary shell, said bottom including a plurality of bottom flanges, each being integral with one of said shell panels, said bottom and said bottom flanges being defined by fold lines, each bottom flange being aligned with, and attached to, an interior portion of one of said shell panels, said bottom having a bottom orifice through which said column extends upwardly, and said bottom having a bottom surface resting on the annular flange of said bearing;

a top integrally formed with the blank which is formed into said rotary shell and closing an upper portion of said rotary shell, said top including a plurality of top flanges, each being integral with one of said shell panels, said top and said top flanges being defined by fold lines, each top flange being aligned with, and attached to, an interior portion of one of said shell panels, said top having a top orifice through which said column extends upwardly and two parallel spaced slots in said top, each lying on a tangent of a circle concentric with said orifice; and a channel shaped restraint member fixed to each shell panel, each member having an elongate planar portion fixed to the outer surface of one of said shell panels, opposed U in cross-section edge portions integral with said planar portion and forming therewith a generally C-shaped card receiving slot, and a bottom flange extending outwardly from said planar portion and defining a bottom rest for a card received in said card receiving slot;

a plurality of product cards each bearing a plurality of products to be displayed, the products being releasably affixed in shingle fashion to each card, and each product card being slidably received in one of said card receiving slots and an inverted V-shaped cap formed from a blank of paperboard stock and having two side panels connected at a fold line, each side panel having a tab which is received in one of said parallel spaced slots in said top.

* * * * *

UNITED STATES PATENT AND TRADEMARK OFFICE

CERTIFICATE OF CORRECTION

PATENT NO. : 4,784,277

DATED : November 15, 1988

INVENTOR(S) : Patricia I. Wallish

It is certified that error appears in the above-identified patent and that said Letters Patent is hereby corrected as shown below:

On the title page:

Item [19], "Wallish et al" should be -- Wolfe et al --

"[75] Inventors: Patricia I. Wallish, "

should be --[75] Inventors: Patricia I. Wolfe, --.

Column 2, line 56, after "of" insert --FIG. 1--;

line 59, after "3-3" insert --of--;

Column 3, line 12, delete "10";

Column 4, line 3, before "thereon" insert --12--.

Signed and Sealed this

Twenty-first Day of November, 1989

*Attest:*

JEFFREY M. SAMUELS

*Attesting Officer* *Acting Commissioner of Patents and Trademarks*